US010027069B2

(12) United States Patent
Huang et al.

(10) Patent No.: US 10,027,069 B2
(45) Date of Patent: Jul. 17, 2018

(54) CABLE CONNECTOR ASSEMBLY HAVING A PROTECTIVE COVER ENCLOSING A THERMISTOR

(71) Applicant: FOXCONN INTERCONNECT TECHNOLOGY LIMITED, Grand Cayman (KY)

(72) Inventors: Chien-Hsun Huang, New Taipei (TW); Dou-Feng Wu, Kunshan (CN); Shuo Liu, Kunshan (CN); Xiao-Li Li, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/814,379

(22) Filed: Nov. 15, 2017

(65) Prior Publication Data

US 2018/0138643 A1 May 17, 2018

(30) Foreign Application Priority Data

Nov. 15, 2016 (CN) ..... 2016 1 1005348

(51) Int. Cl.

| | |
|---|---|
| ***H01R 13/33*** | (2006.01) |
| ***H01R 13/66*** | (2006.01) |
| ***H01R 13/52*** | (2006.01) |
| ***H01R 13/504*** | (2006.01) |
| *H01R 107/00* | (2006.01) |
| *H01R 24/64* | (2011.01) |

(52) U.S. Cl.
CPC ..... *H01R 13/6683* (2013.01); *H01R 13/504* (2013.01); *H01R 13/5213* (2013.01); *H01R 24/64* (2013.01); *H01R 2107/00* (2013.01)

(58) Field of Classification Search
CPC ..... H01R 13/6658
USPC ..... 439/620.22, 620.08, 607.46, 607.47, 439/607.48, 607.51
See application file for complete search history.

(56) References Cited

U.S. PATENT DOCUMENTS

| | | | | |
|---|---|---|---|---|
| 9,716,350 | B2 * | 7/2017 | Taniguchi | H01R 13/46 |
| 2008/0096429 | A1 * | 4/2008 | Mikolajczak | H01R 13/6666 439/620.08 |
| 2016/0197500 | A1 | 7/2016 | Liang | |

FOREIGN PATENT DOCUMENTS

| | | |
|---|---|---|
| CN | 202632919 | 12/2012 |
| CN | 203491732 | 3/2014 |
| CN | 205960251 | 2/2017 |
| TW | 201717504 | 5/2017 |

* cited by examiner

*Primary Examiner* — Phuong Dinh
(74) *Attorney, Agent, or Firm* — Wei Te Chung; Ming Chieh Chang

(57) ABSTRACT

A cable connector assembly includes: a mating unit; a cable; a printed circuit board (PCB) interconnected between the mating unit and the cable, the PCB carrying a thermistor; a protective cover mounted on the PCB and enclosing the thermistor; a metal shell enclosing the PCB, a rear of the mating unit, and a front of the cable; an insulative inner cover over-molding the PCB, the metal shell, the rear of the mating unit, and the front of the cable; and an insulative outer cover over-molding the inner cover.

3 Claims, 14 Drawing Sheets

CABLE CONNECTOR ASSEMBLY HAVING A PROTECTIVE COVER ENCLOSING A THERMISTOR

BACKGROUND OF THE INVENTION

1. Field of the Invention

The present invention relates to a cable connector assembly having an internal printed circuit board carrying a thermistor and a protective cover mounted on the printed circuit board and enclosing the thermistor.

2. Description of Related Arts

U.S. Patent Application Publication No. 2016/0197500, published on Jul. 7, 2016, discloses a mobile terminal charger comprising a thermistor and a charger output protection circuit. Specifically shown is a cable connector assembly comprising: a mating unit; a cable; a printed circuit board (PCB) interconnected between the mating unit and the cable, the PCB carrying a thermistor; a metal shell enclosing the PCB, a rear of the mating unit, and a front of the cable; an insulative inner mold; and an insulative outer mold. The thermistor may adopt a positive temperature coefficient (PTC) resistor in series with another resistor in the charger.

China Patent No. 202632919, issued on Dec. 26, 2012, discloses a precision thermistor mounted on a PCB, comprising a resistor, a heat-conducting plate spaced from the resistor, and a packing cover. The resistor includes a heat-sensing part and a pair of electrodes. The packing cover encloses the heat-sensing part of the resistor and respective parts of the heat-conducting plate and the electrodes.

SUMMARY OF THE INVENTION

A cable connector assembly comprises: a mating unit; a cable; a printed circuit board (PCB) interconnected between the mating unit and the cable, the PCB carrying a thermistor; a protective cover mounted on the PCB and enclosing the thermistor; a metal shell enclosing the PCB, a rear of the mating unit, and a front of the cable; an insulative inner cover over-molding the PCB, the metal shell, the rear of the mating unit, and the front of the cable; and an insulative outer cover over-molding the inner cover.

DETAILED DESCRIPTION OF THE PREFERRED EMBODIMENTS

Figure 1:
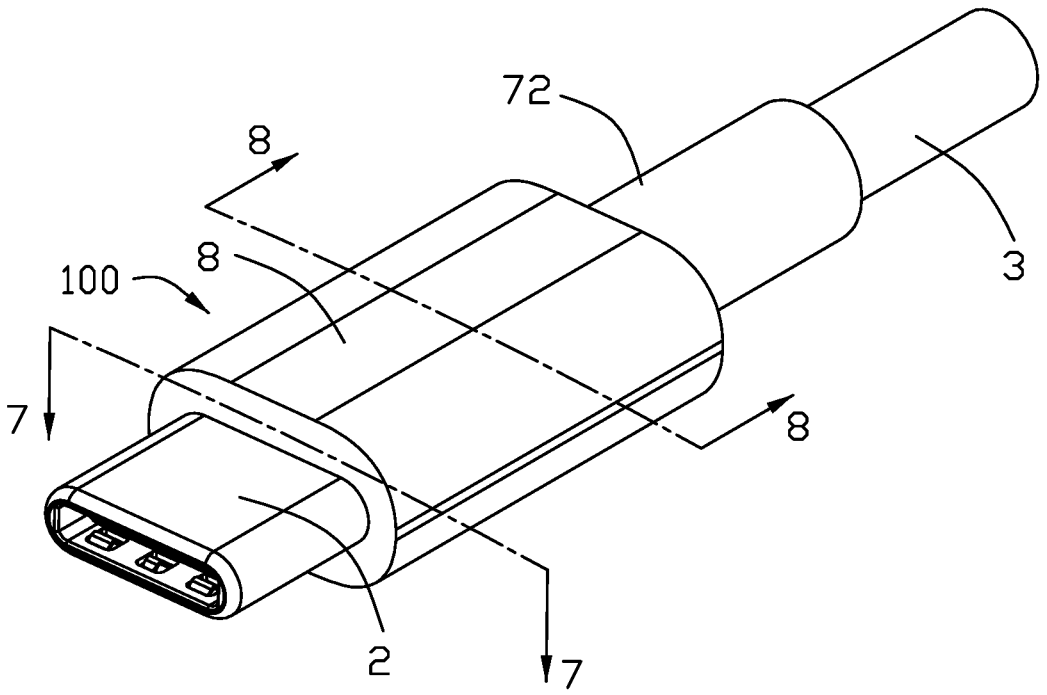
FIG. 1 is a perspective view of a cable connector assembly in accordance with a first embodiment of the present invention.
Figure 2:
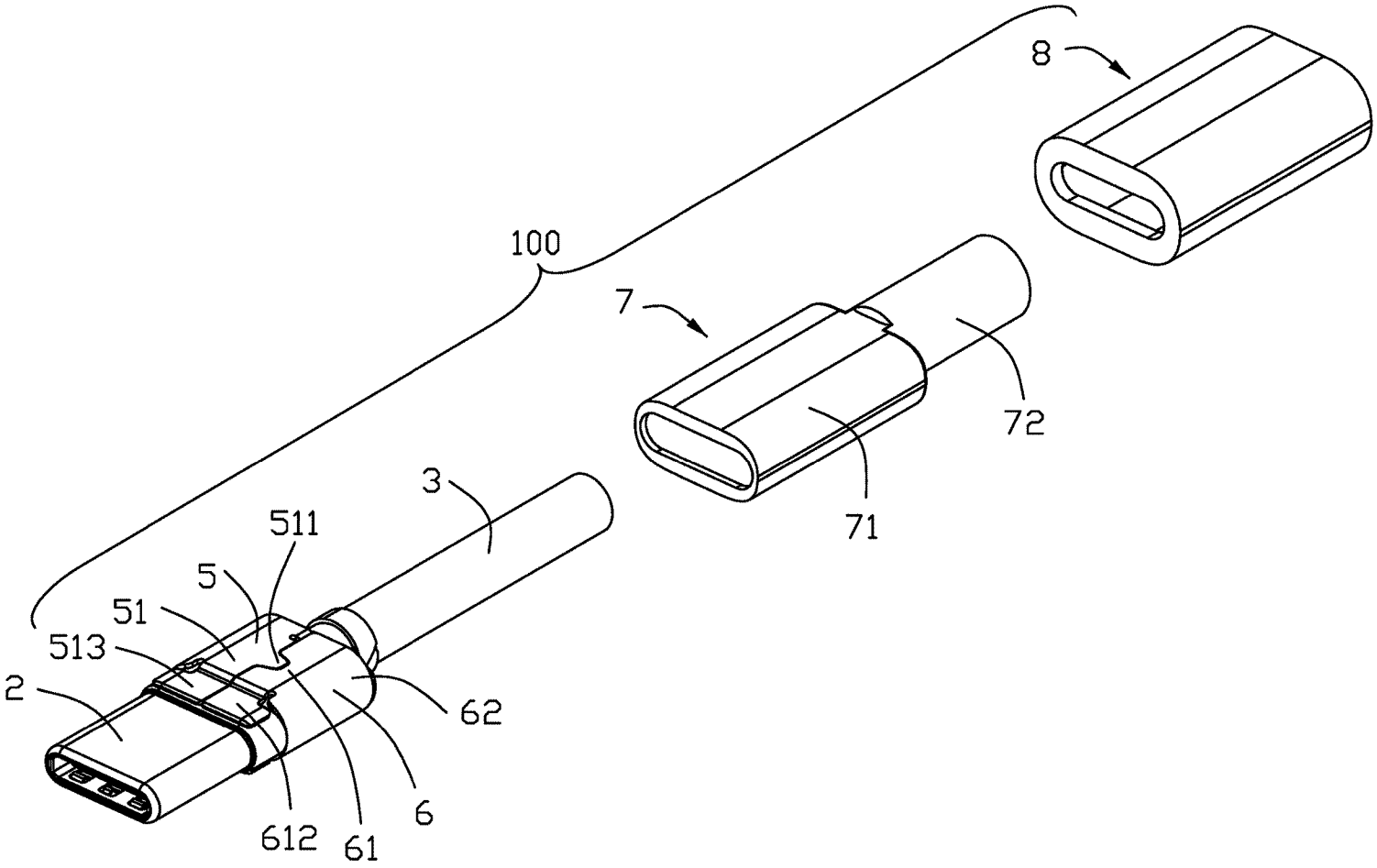
FIG. 2 is a partly exploded view of the cable connector assembly.

Referring to FIGS. 1-8, a cable connector assembly 100 comprises: a mating unit 2; a cable 3; a printed circuit board (PCB) 1 interconnected between the mating unit and the cable; a protective cover 4 mounted on the PCB 1; a metal shell enclosing the PCB 1, a rear of the mating unit 2, and a front of the cable 3; an insulative inner cover 7 over-molding the PCB 1, the metal shell, the rear of the mating unit 2, and the front of the cable 3; and an insulative outer cover 8 over-molding the inner cover 7.

Figure 3:
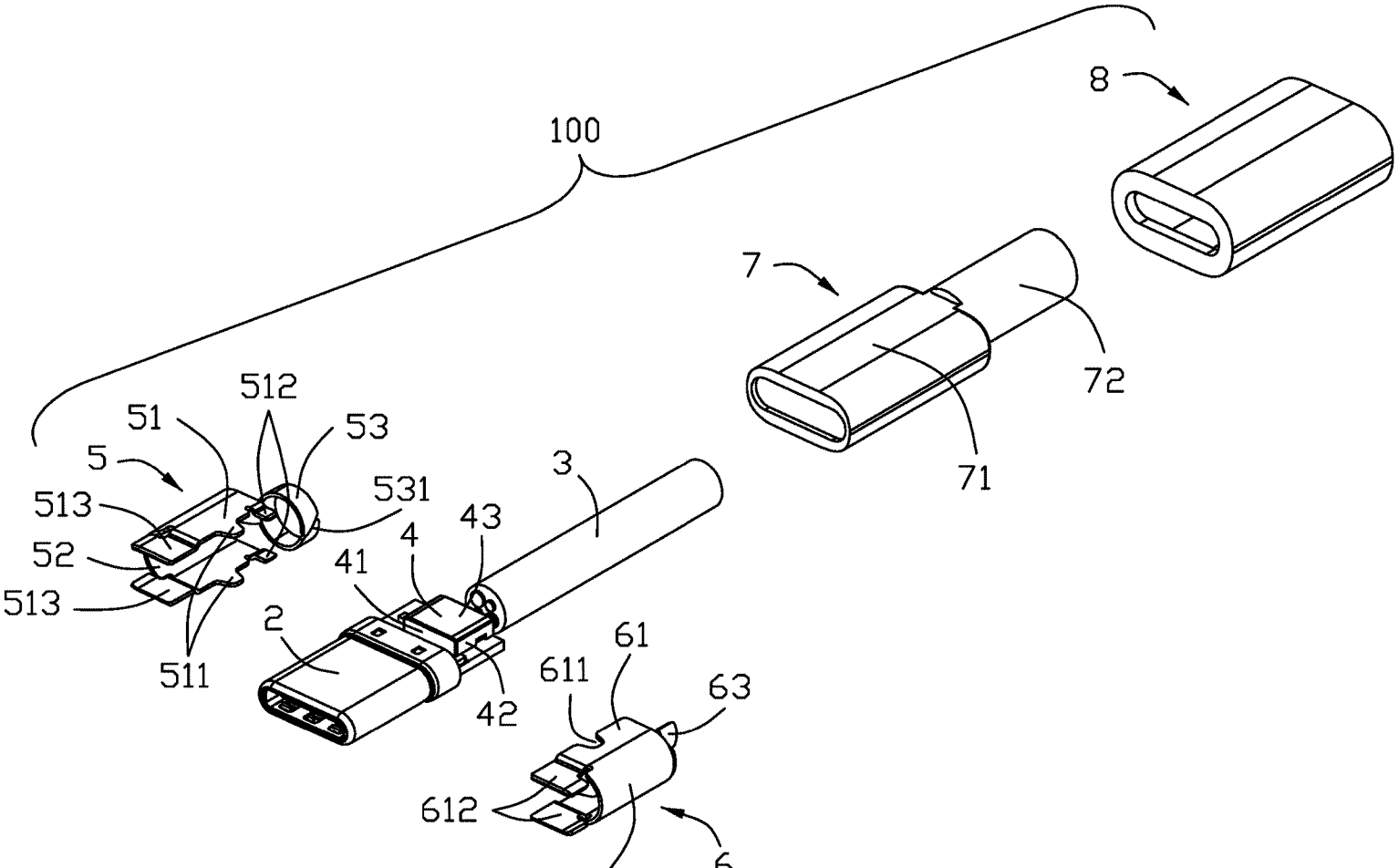
FIG. 3 is a further exploded view of the cable connector assembly.
Figure 4:
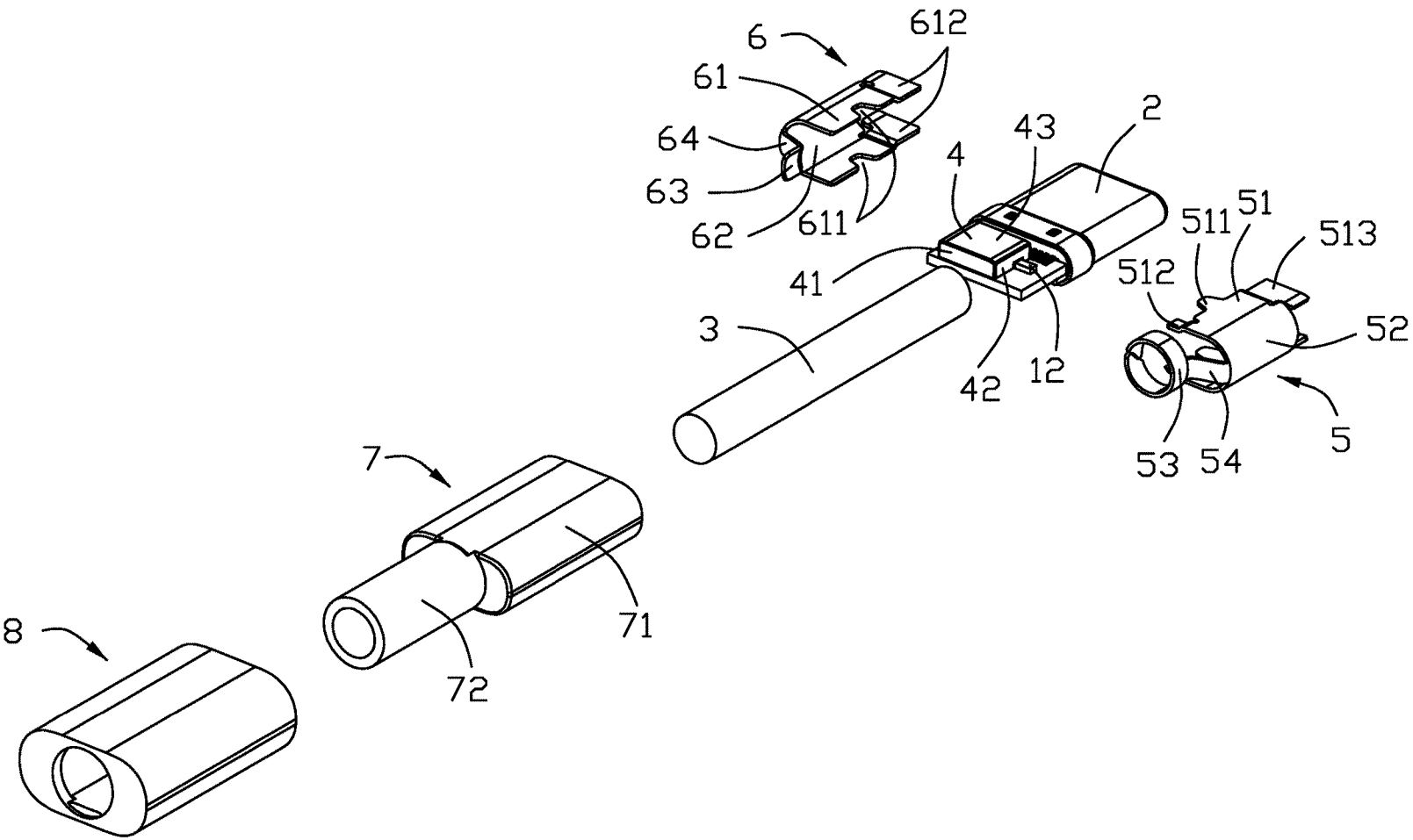
FIG. 4 is a view similar to FIG. 3 but from a different perspective.
Figure 5:
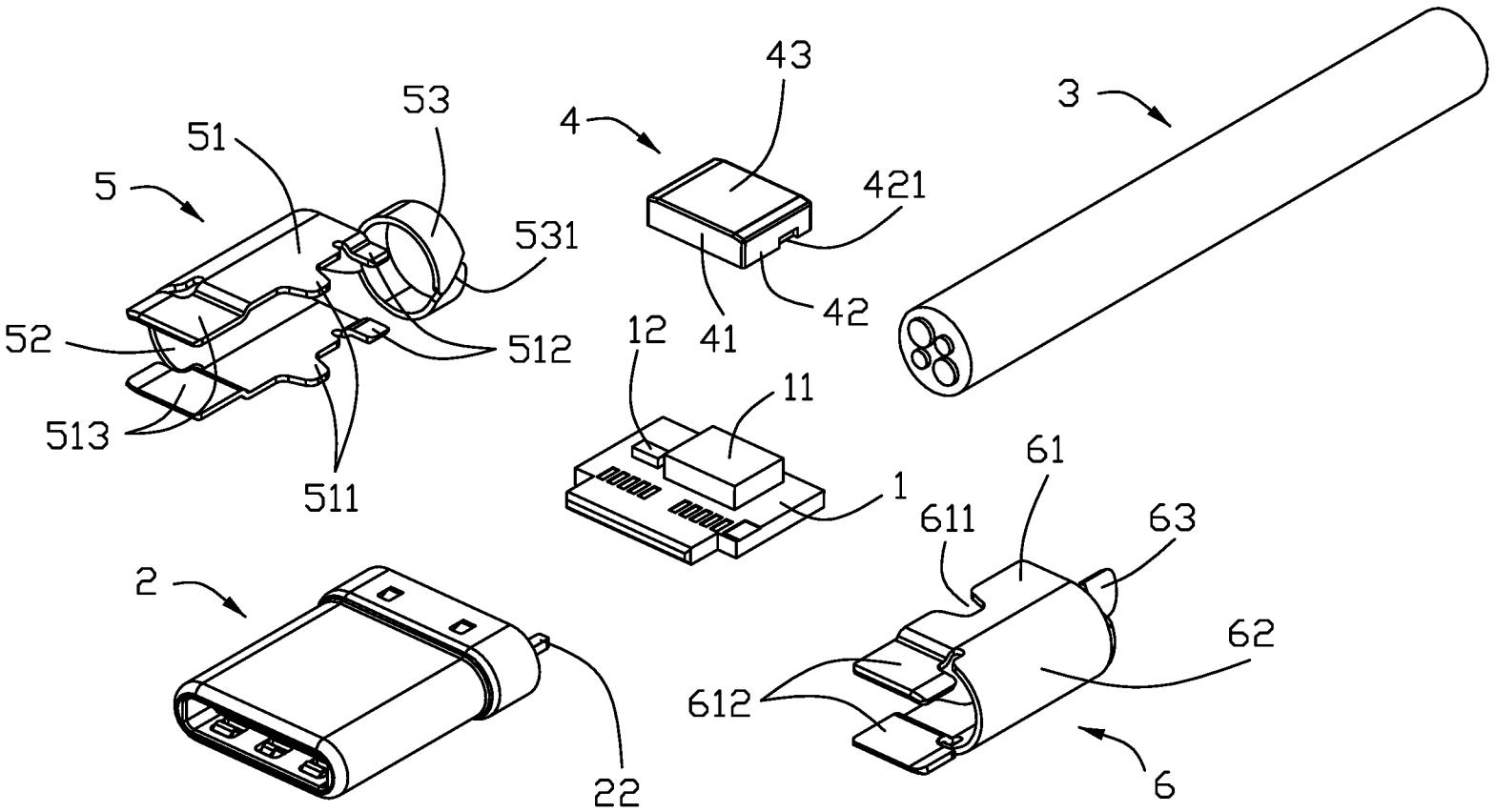
FIG. 5 is a still further exploded view of the cable connector assembly in FIG. 3 omitting an inner and outer covers thereof.
Figure 6:
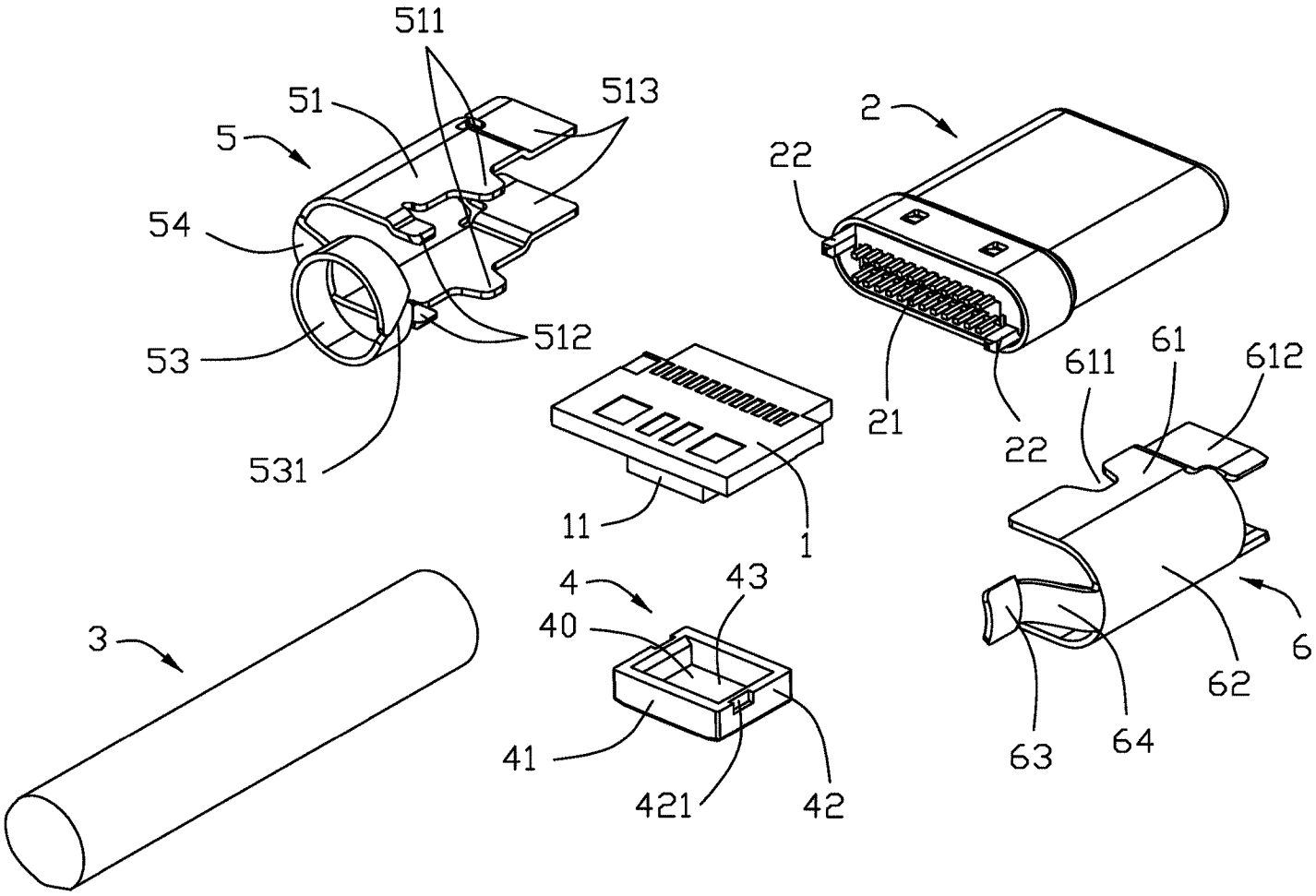
FIG. 6 is a view similar to FIG. 5 but from a different perspective.
Figure 7:
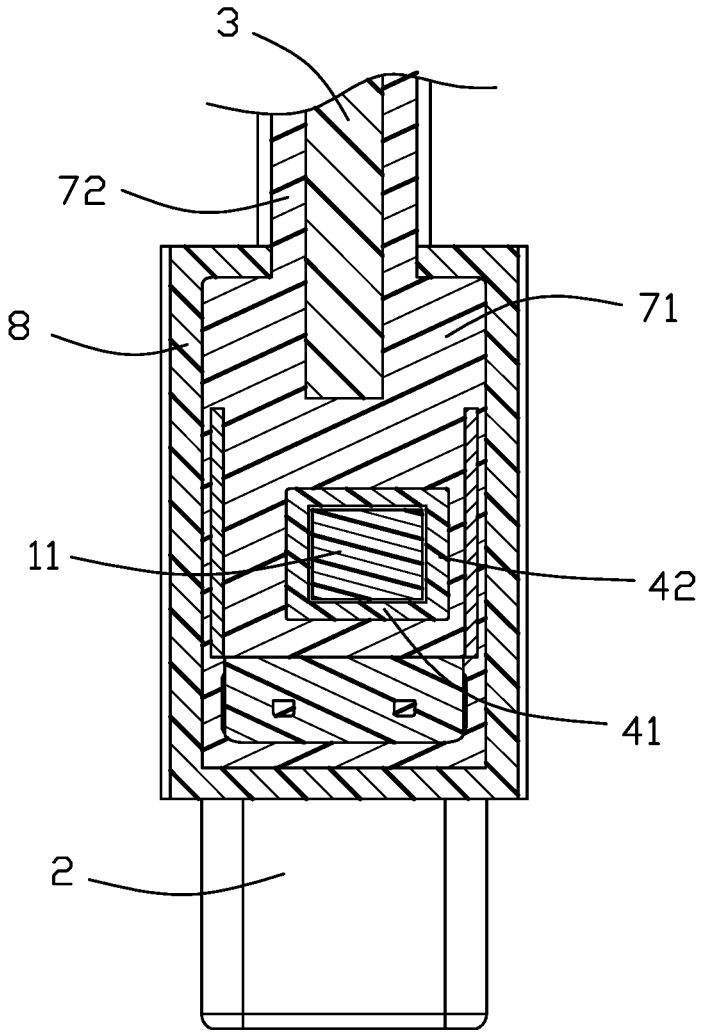
FIG. 7 is a cross-sectional view of the cable connector assembly in FIG. 1 taken along line A-A.
Figure 8:
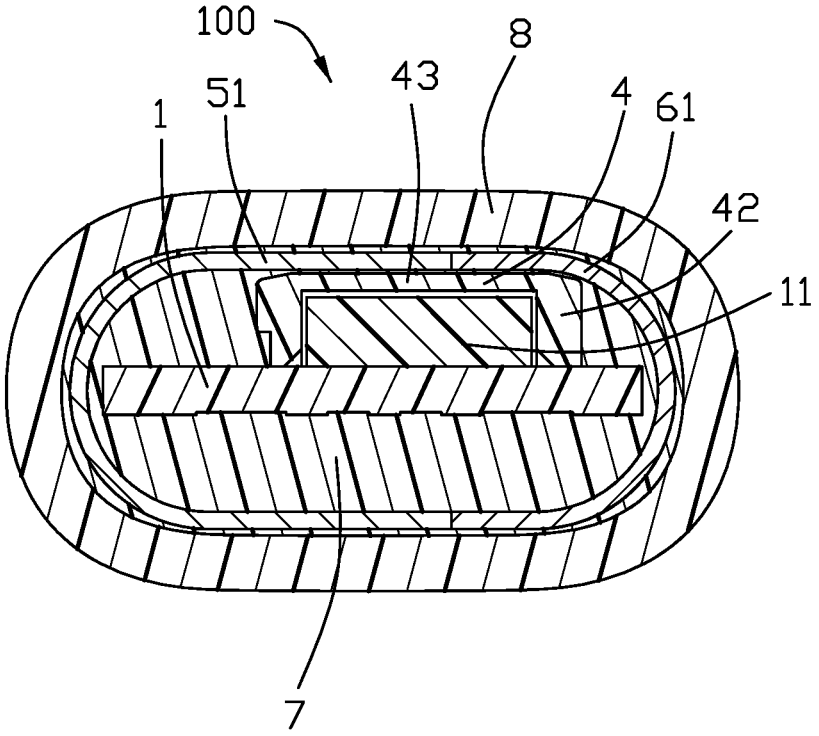
FIG. 8 is a cross-sectional view of the cable connector assembly in FIG. 1 taken along line B-B.
Figure 9:
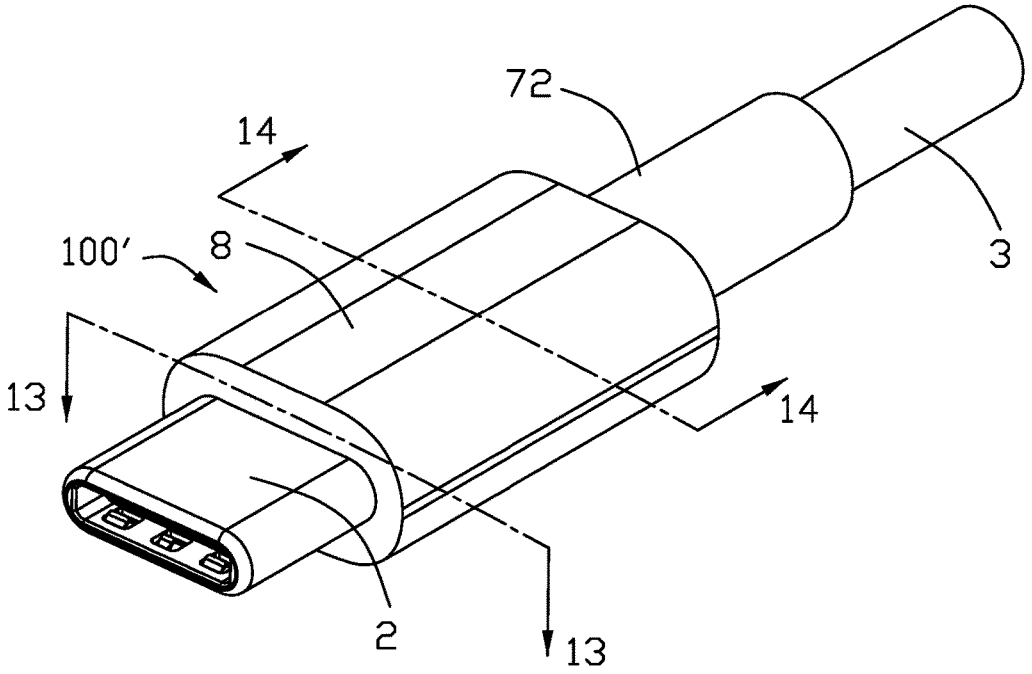
FIG. 9 is a perspective view of a cable connector assembly in accordance with a second embodiment of the present invention.
Figure 10:
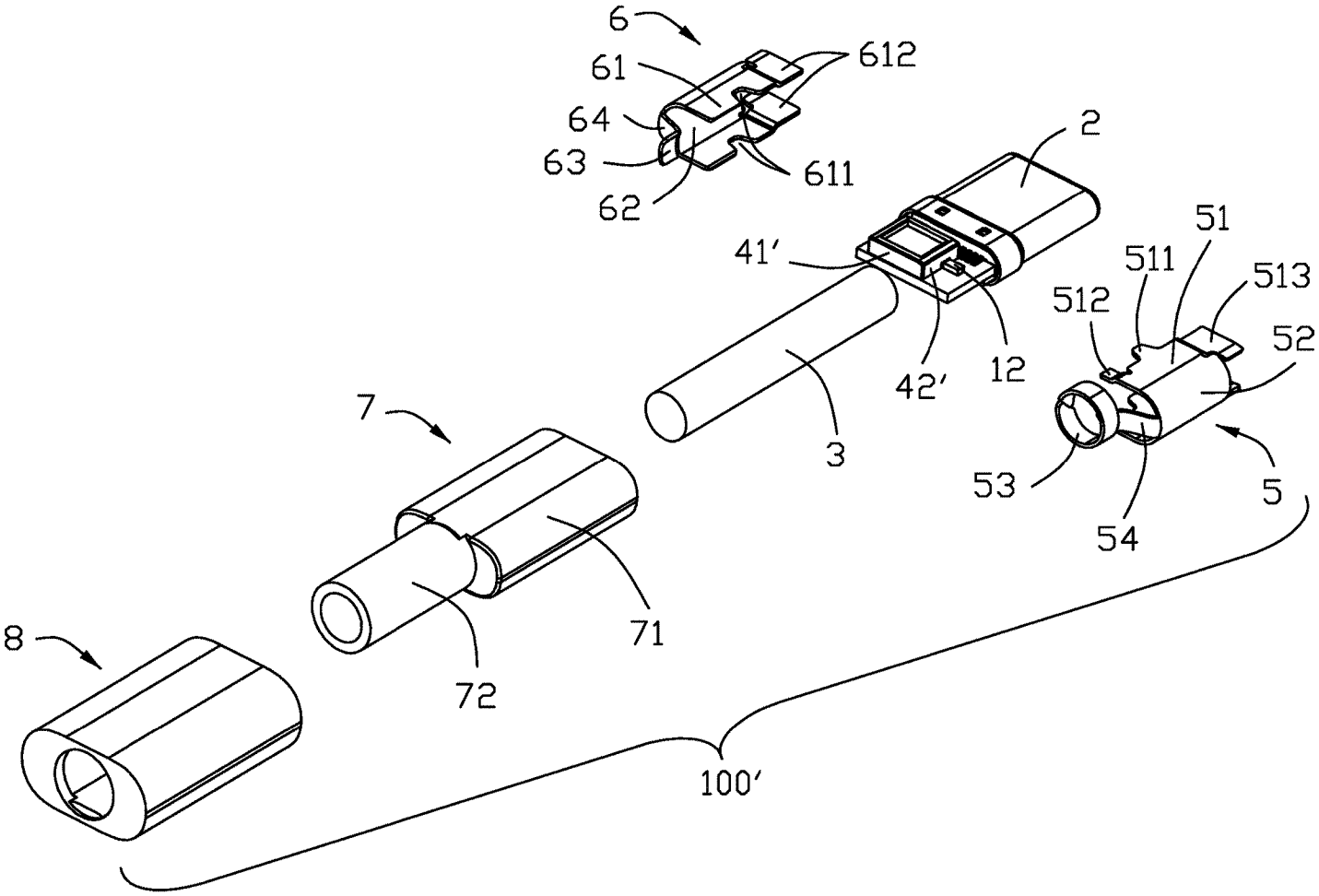
FIG. 10 is a partly exploded view of the cable connector assembly in FIG. 9.
Figure 11:
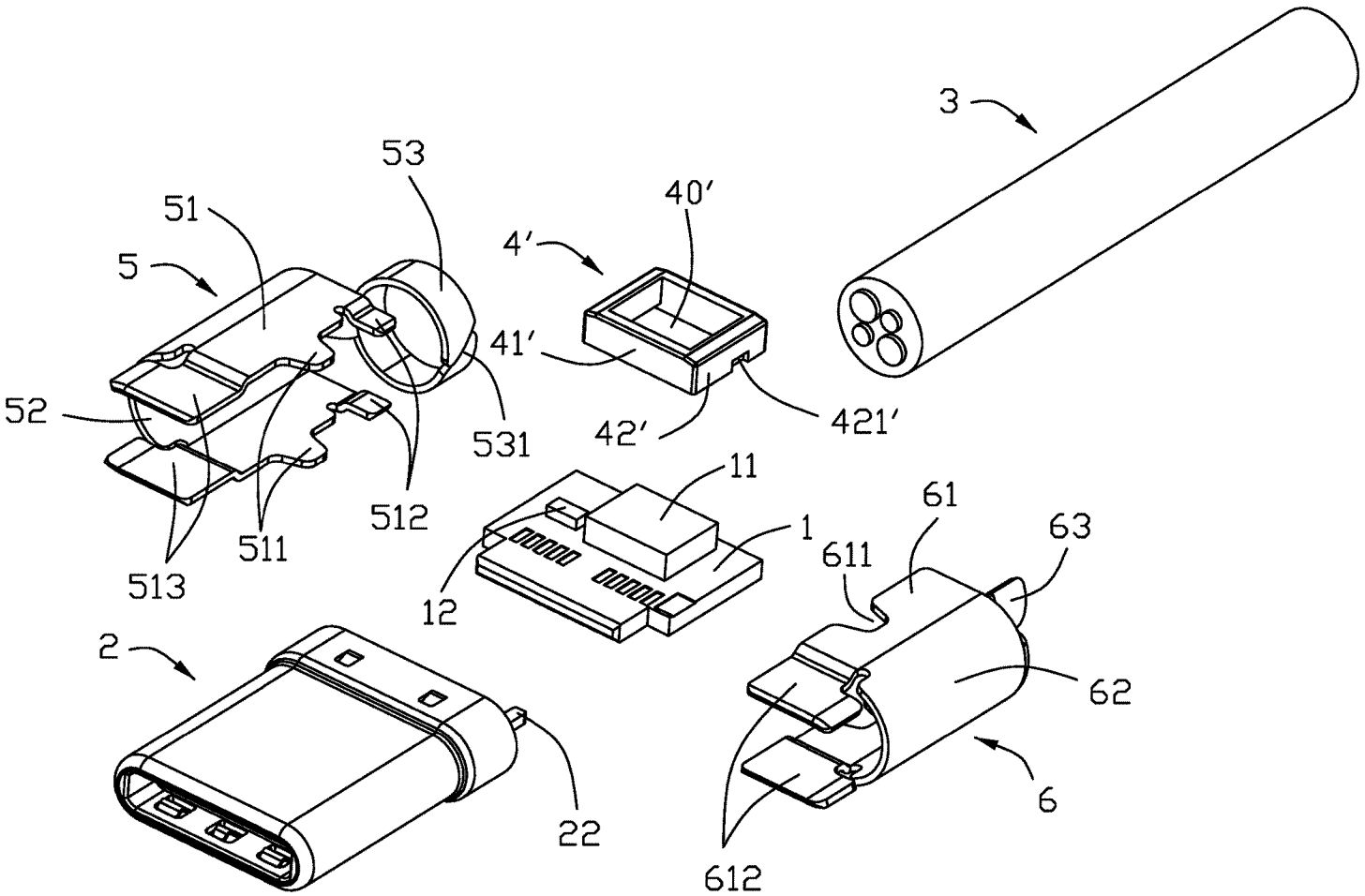
FIG. 11 is a further exploded view of the cable connector assembly in FIG. 10 omitting an inner and outer covers thereof.
Figure 12:
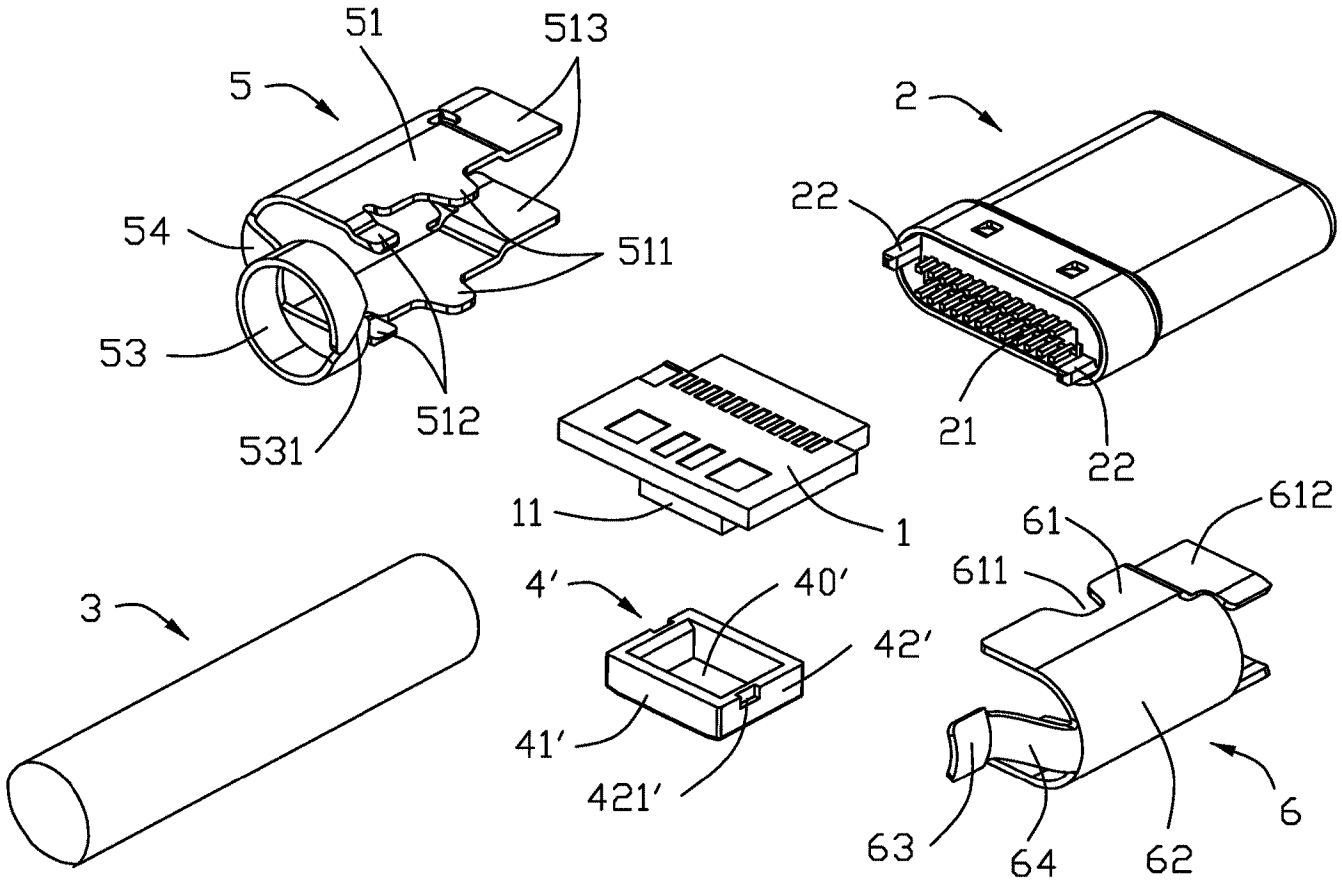
FIG. 12 is a view similar to FIG. 11 but from a different perspective.
Figure 13:
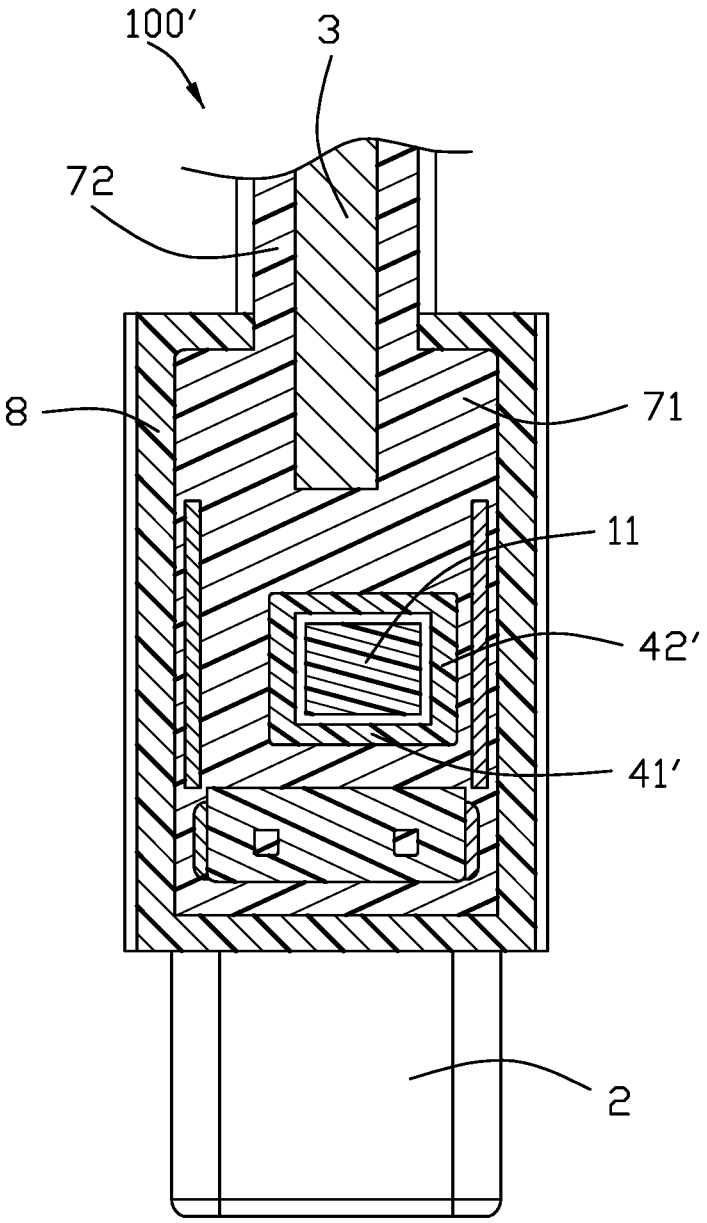
FIG. 13 is a cross-sectional view of the cable connector assembly in FIG. 9 taken along line C-C.
Figure 14:
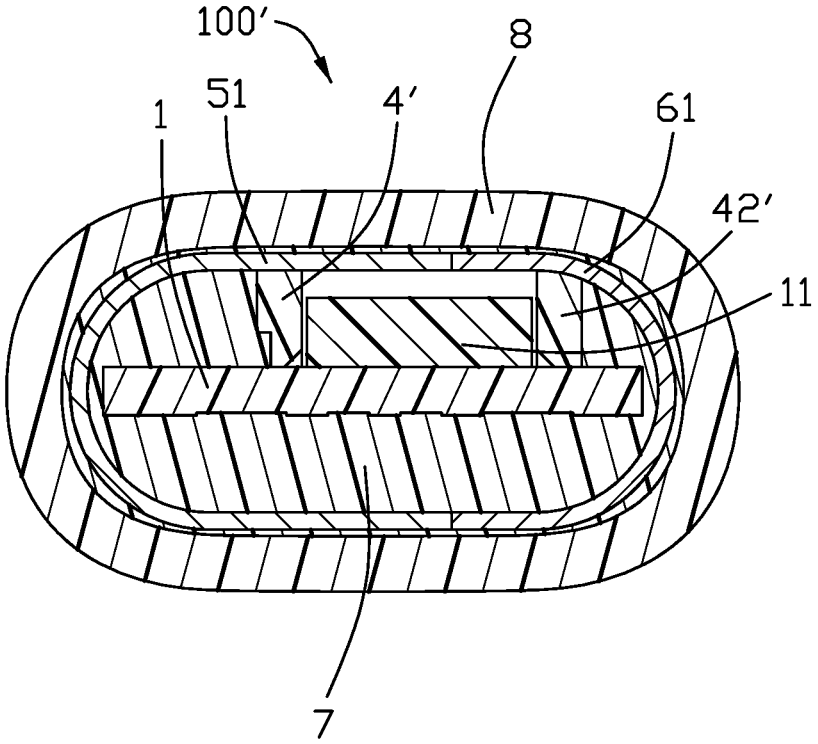
FIG. 14 is a cross-sectional view of the cable connector assembly in FIG. 9 taken along line D-D.

Referring to FIGS. 3 and 5-6, on the PCB 1 is soldered an over-current protection element 11 and a capacitor 12. The over-current protection element 11 is a thermistor, e.g., Positive Temperature Coefficient or PTC type. With PTC thermistors, resistance increases as temperature rises. PTC thermistors are commonly installed in series with a circuit, and used to protect against overcurrent conditions. The thermistor 11 may expand under increased temperatures.

The mating unit 2 or plug connector is of a reverse-symmetrical type capable of mating in two orientations. The mating unit 2 or plug connector includes two rows of rear soldering tails 21 and a pair of securing legs 22.

The protective cover 4 includes a fence and a top wall 43. The cover 4 may be rectangular or cylindrical. The fence has a pair of first side walls 41 and a pair of second side walls 42, which together with the top wall 43, enclose a receiving space 40. Each of the pair of second side walls 42 has an opening 421. A lateral dimension of the first side wall 41 is greater than a left-and-right width of the thermistor 11 and a longitudinal dimension of the second side wall 41 is greater than a front-and-back length of the thermistor 11. The first and second side walls 41 and 42 are each taller than a height of the thermistor 11.

The metal shell includes a first shell part 5 and a second shell part 6. The first shell part 5 includes an upper and lower main portions 51 having features 511, 512, and 513, a side portion 52 between the two main portions, a fastening portion 53 having a feature 531, and a linking portion 54. The second shell part 6 is similarly designed to include main portions 61 having features 611 and 612, curved side portion 62, fastening portion 63, and linking portion 64.

The insulative inner cover 7 has a first covering portion 71 and a second covering portion 72. The insulative outer cover 8 is tubular.

The cable connector assembly 100 is manufactured in a generally known way as to the mating unit 2, the cable 3, interconnecting the PCB 1 between the mating unit 2 and the cable 3, enclosing the metal shell, and over-molding the insulative inner and outer covers. As for mounting the thermistor 11 and the protective cover 4 to the PCB 1, it is generally straightforward except for otherwise indicated. Basically, the protective cover 4 so encloses the thermistor 11 in the receiving space 40 as to leave a gap for accommodating any expansion of the thermistor 11. Such gap does not exist if the thermistor 11 is buried by or embedded in the insulative inner cover 7.

The openings 421 on the pair of second side walls 42 in cooperation with the capacitor 12 enable a time-saving assembling operation during mounting the protective cover 4 to the PCB 1. The insulative outer cover 8 reinforces the insulative inner cover 7. In this embodiment, the protective cover 4 is specifically mounted upon the PCB 1 to enclose the thermistor 11. Anyhow, in an alternate design, if the metal shell can fully enclose the PCB 1 ideally, the inner cover 7 may not invade the gap between the metal shell and the PCB 1. Under such a situation, the protective cover 4 may be eliminated and the metal shell (5, 6) may provide the function of the protective cover 4 for the thermistor 11. In other words, a rigid structure which may cooperate with the PCB 1 to fully circumferentially surround the thermistor 11 for prevent the inner cover 7 from contacting the terminstor 11, is either a combination of the metal shell (5, 6) and the protective cover 4, or even a single metal shell in an ideal situation.

Referring to FIGS. 9-14, the second embodiment is different from the first embodiment only in the design of a protective cover 4' which does not have a top wall. Specifically, the protective cover 4' also encloses the thermistor 11' in the receiving space 40' so as to leave a gap for accommodating any expansion of the thermistor 11', preferably in all directions. Absence of a top wall in the protective cover 4' is alleviated by close arrangement of the fence thereof to the upper main portions 51 and 61 of the first and second shell parts 5 and 6, preferably in contact. Understandably, there is also a gap between the upper main portions 51 and 61 and a top of the thermistor 11'.

What is claimed is:

1. A cable connector assembly comprising:

a mating unit;

a cable;

a printed circuit board (PCB) interconnected between the mating unit and the cable, the PCB carrying a thermistor;

a protective cover mounted on the PCB and enclosing the thermistor;

a metal shell enclosing the PCB, a rear of the mating unit, and a front of the cable;

an insulative inner cover over-molding the PCB, the metal shell, the rear of the mating unit, and the front of the cable; and an insulative outer cover over-molding the inner cover; wherein the protective cover is spaced from the thermistor by a gap; wherein the protective cover prevents molding material of the insulative inner cover from embedding the thermistor; wherein the protective cover has a fence and a top wall.

2. A cable connector assembly comprising:

a mating unit;

a cable;

a printed circuit board (PCB) interconnected between the mating unit and the cable, the PCB carrying a thermistor thereon;

a rigid structure enclosing the PCB and the thermistor thereon with gaps with regard to the thermistor both vertically and horizontally;

an insulative inner cover applied upon a rear of the mating unit, a front of the cable and the rigid structure; and an insulative outer cover over-molding the inner cover; wherein the inner cover is spatially spaced from the thermistor so as not to jeopardize a function of the thermistor; wherein the rigid structure includes a metal shell; wherein said rigid structure further includes a protective cover directly mounted upon the PCB and enclosed within the metal shell; wherein said protective cover fully circumferentially surrounds the thermistor except a bottom side which is covered by the PCB or further a top side covered by the metal shell; wherein said thermistor is protectively spaced from the inner cover at least by said protective cover or further by said metal shell.

3. A cable connector assembly comprising:

a mating unit;

a cable;

a printed circuit board (PCB) interconnected between the mating unit and the cable, the PCB carrying a thermistor;

a protective cover mounted on the PCB and enclosing the thermistor;

a metal shell enclosing the PCB, a rear of the mating unit, and a front of the cable;

an insulative inner cover over-molding the PCB, the metal shell, the rear of the mating unit, and the front of the cable; and an insulative outer cover over-molding the inner cover; wherein the protective cover is spaced from the thermistor by a gap; wherein the protective cover prevents molding material of the insulative inner cover from embedding the thermistor; wherein the protective cover has a fence and an open top, the fence being close to or in contact with the metal shell.

* * * * *